US006602575B2

(12) United States Patent
Lefevre Du Grosriez et al.

(10) Patent No.: US 6,602,575 B2
(45) Date of Patent: Aug. 5, 2003

(54) STACK AND METHOD FOR STACKING FOLDED SUPPLE SHEETS

(75) Inventors: Carol Lefevre Du Grosriez, Oberhergheim (FR); Remy Ruppel, Durrenentzen (FR); Jean-Louis Neveu, Colmar (FR)

(73) Assignee: Georgia-Pacific France, Kunheim (FR)

( * ) Notice: Subject to any disclaimer, the term of this patent is extended or adjusted under 35 U.S.C. 154(b) by 116 days.

(21) Appl. No.: 09/791,799

(22) Filed: Feb. 26, 2001

(65) Prior Publication Data

US 2001/0025856 A1 Oct. 4, 2001

(30) Foreign Application Priority Data

Feb. 25, 2000 (EP) ..... 00400506

(51) Int. Cl.[7] ..... B32B 3/04
(52) U.S. Cl. ..... 428/124; 428/121
(58) Field of Search ..... 428/124, 121, 428/126; 221/48, 47

(56) References Cited

U.S. PATENT DOCUMENTS 1,666,553 A 4/1928 Christman
4,638,921 A * 1/1987 Sigl et al. ..... 221/1
5,736,224 A * 4/1998 Dodge ..... 428/153
5,755,413 A * 5/1998 Press ..... 24/570

FOREIGN PATENT DOCUMENTS

EP 0 286 538 10/1988
EP 0 980 841 2/2000

* cited by examiner

*Primary Examiner*—Harold Pyon
*Assistant Examiner*—Jane Rhee
(74) *Attorney, Agent, or Firm*—Finnegan, Henderson, Farabow, Garrett & Dunner, L.L.P.

(57) ABSTRACT

The invention proposes a stack (50) of supple and absorbent sheets, for example made of cellulose wadding, which comprise a longitudinal fold line (22) forming a longitudinal border (28) and at least one transverse fold line (30) perpendicular to the longitudinal fold line (22), characterized in that the longitudinal (22) and transverse (30) fold lines of an upper folded sheet (36) in the stack are not adjacent to the respective longitudinal (22) and transverse (30) fold lines of the previous lower folded sheet (36).

11 Claims, 5 Drawing Sheets

Fig. 15
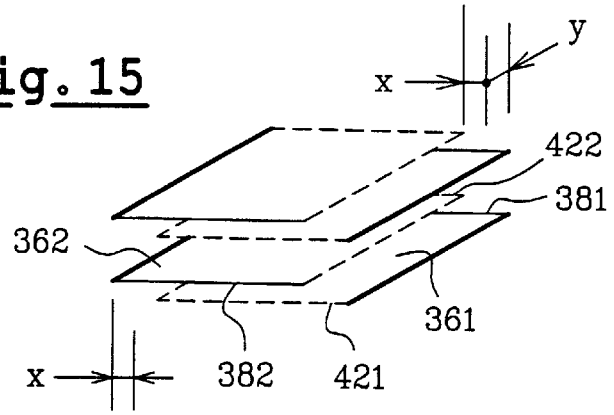
Fig. 16
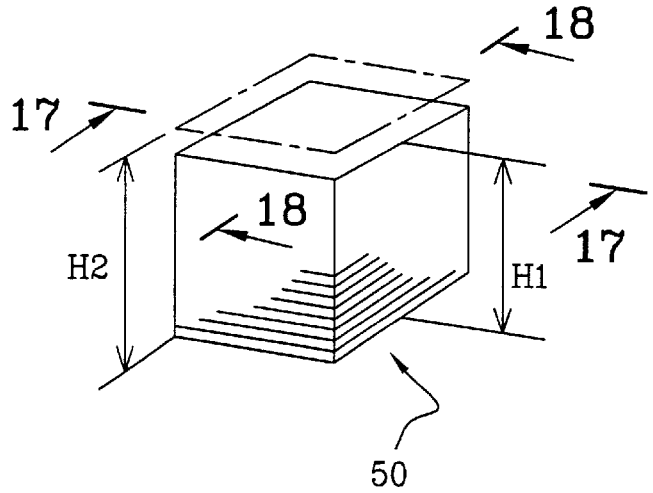
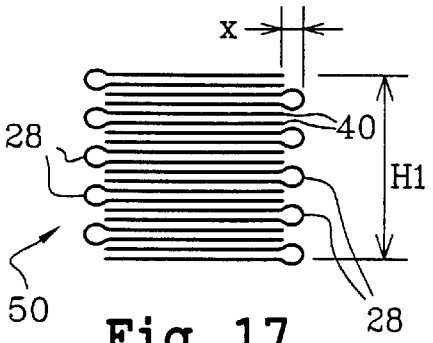
Fig. 17
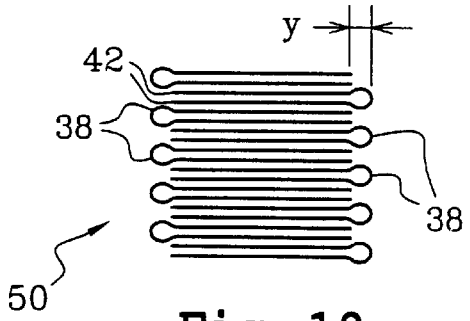
Fig. 18

STACK AND METHOD FOR STACKING FOLDED SUPPLE SHEETS

SUMMARY OF THE INVENTION

The invention relates to a stack of folded supple and absorbent sheets.

The invention relates more specifically to a stack of supple and absorbent sheets, particularly made of cellulose wadding, which has a longitudinal fold line forming a longitudinal border and at least one transverse fold line perpendicular to the longitudinal fold line.

These sheets may in particular be used as table napkins. They then consist of four supple panels separated from each other by a longitudinal fold line and a transverse fold line.

There are various types of stack.

The sheets may simply be placed one on top of the next, the longitudinal fold and the transverse fold of an upper sheet then being superposed with the respective longitudinal fold and transverse fold of a lower sheet.

The sheets may also be stacked in such a way that the transverse fold of the upper sheet is superposed with the edge opposite the transverse fold of the lower sheet, the longitudinal folds of the upper and lower sheets being superposed.

Another way of stacking the sheets consists in intertwining them.

In this case, having folded the sheets longitudinally, the sheets are folded transversely and are folded down alternately in one direction and in the opposite direction so that two sheets folded in the same direction are half inserted between the transverse fold of an intermediate third sheet folded in the opposite direction.

This last way of stacking makes it possible, when the upper sheet is pulled via its upper half, for this to pull the next sheet along also, by virtue of the forces of friction between the lower half of the upper sheet and the upper half of the intermediate lower sheet.

Such stacks of folded and intertwined sheets are used in particular for hand towels in areas of communal use. In general, the lower sheet of the stack is placed directly on a roughly horizontal flat surface, the stack extending vertically upwards.

Another common solution for table napkins consists in placing the stack of non-intertwined sheets inside a dispenser which consists of a body, the cross section of which roughly corresponds to the outline of the sheets. A pusher equipped with elastic means is located at one of the ends of the body and allows the lower sheet of the stack to be pushed longitudinally towards the other end which has an opening allowing the first sheet to be grasped. Such a dispenser is generally arranged so that its longitudinal axis is roughly horizontal.

To make storage easier and to reduce the amount of handling of the sheets, the stacks contain a high number of sheets. Now, such stacks are not symmetric with respect to their main axis of stacking and specifically are not geometrically symmetric because the thicknesses of the longitudinal and transverse folds of a sheet are greater than the thickness that corresponds to the superposition of the panels of the folded sheet, which leads to a lessening of the distribution of their mass with respect to the axis of stacking because the folded borders contain more material and are heavier than the free edges of the folded sheets.

The result of the dissymmetry of the stack is to unbalance the stack and, in some cases, to cause it to topple when it is placed vertically on a horizontal surface.

In addition, the sheet located at the top of the stack is not flat because the superposition of the folded borders causes its borders to be "raised" by comparison with the unfolded edges. This does not allow the longitudinal bulk of the stack to be minimized and may disrupt the operation of the supple sheet dispenser when such a dispenser is used.

The dissymmetry of the stack may also jam the dispenser in which it may be placed.

This is because when the upper sheet of the stack is pressed against the end of the dispenser which has the opening, the lower sheet is not perpendicular to the longitudinal axis, the thrusting forces applied by the elastic means then not being distributed uniformly over the lower sheet, which encourages malfunctioning and in particular encourages the pusher to jam or causes the lower sheets of the stack to become crumpled.

In order to remedy these drawbacks, the invention proposes a stack of supple sheets of the type described earlier, characterized in that the longitudinal and transverse fold lines of an upper sheet in the stack are not adjacent to the respective longitudinal and transverse fold lines of the previous lower sheet.

Thus, the stack has geometric symmetry and a distribution of the weight of the folded supple sheets which allow the stack to remain balanced with respect to the axis of stacking, regardless of the number of folded supple sheets.

According to other characteristics of the invention:

- the longitudinal fold line of an upper folded sheet is parallel to and transversely opposite the longitudinal fold line of the previous lower folded sheet and the transverse fold line of the upper folded sheet is parallel to and longitudinally opposite the transverse fold line of the lower folded sheet;
- two successive folded sheets are intertwined;
- the longitudinal fold line of the upper folded sheet is superposed with the edge of the previous lower folded sheet which edge is the opposite edge to the longitudinal fold line of this lower folded sheet;
- the longitudinal fold line of the upper folded sheet is transversely offset towards the outside of the stack with respect to the longitudinal edge of the previous lower folded sheet;
- at least one of the transverse fold lines forming a transverse border of the upper folded sheet is superposed with the edge of the lower folded sheet which edge is the opposite edge to the corresponding transverse fold line that forms the transverse border of the lower folded sheet;
- at least one of the transverse fold lines forming a transverse border of the upper folded sheet is longitudinally offset towards the outside of the stack with respect to the transverse edge of the previous lower folded sheet;
- the longitudinal fold line delimits two sections, the transverse dimensions of which are roughly equal;
- the longitudinal fold line delimits two sections, the transverse dimension of one of which is at most twice the transverse dimension of the other;
- the sheets are folded about two transverse fold lines so as to form a central panel and two end flaps which extend facing one same side of the central panel;
- the sheets are folded about two transverse fold lines so as to form a central panel and two end flaps, each of which extends facing one of the sides of the central panel;
- each sheet is folded in four about a longitudinal fold line and about a perpendicular transverse fold line so as to form a stack of square folded sheets, particularly folded napkins;

each folded sheet of the stack consists of at least one ply of supple and absorbent material.

The invention also proposes a method for stacking sheets of supple and absorbent material, particularly cellulose wadding, of the type comprising the following successive steps:

folding two separate webs of material in the longitudinal direction about a longitudinal fold line;

making transverse cuts at regular intervals, so as to produce sheets;

folding the sheets about at least one transverse fold line; and stacking the folded sheets, characterized in that at the end of the stacking step, the longitudinal fold line of the upper folded sheet is roughly opposed, with respect to the lower folded sheet, to the longitudinal fold line of the lower folded sheet.

According to another characteristic of the method according to the invention, the folding and the stacking of the sheets cause the folded sheets to be intertwined.

Other characteristics and advantages of the invention will become apparent upon reading the detailed description which follows, for an understanding of which reference will be made to the appended drawings in which:

BRIEF DESCRIPTION OF THE DRAWINGS

FIG. 15 is a schematic view similar to the view of FIG. 7, in which the upper sheets are longitudinally and transversely offset with respect to the adjacent lower sheet;

FIG. 16 is a schematic perspective view similar to the view of FIG. 8, in which the upper sheets are longitudinally and transversely offset with respect to the adjacent lower sheet;

FIG. 17 is a view in cross section of the stack on a vertical plane passing through 17—17 of FIG. 16;

FIG. 18 is a view in longitudinal section of the stack on a vertical plane passing through 18—18 of FIG. 16;

DETAILED DESCRIPTION OF THE INVENTION

The sheets consist of at least one ply of supple and absorbent material. When there are several plies they may be connected together, for example by bonding or any mechanical means of connection.

In general, for obvious practical reasons associated with bulk, the stacks of supple and absorbent sheets, particularly made of cellulose wadding, are produced after the sheets have been folded, or in the course of folding, in the case of intertwining.

The supple sheets may be square or rectangular and may, for example, have two fold lines, one longitudinal and the other transverse.

Figure 1A:
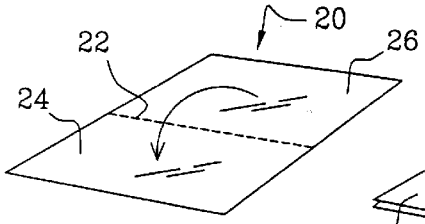
FIGS. 1*a*, 1*b* and 1*c* depict the two successive foldings of a supple sheet.

FIG. 1*a* depicts a square supple sheet 20 on which there has been depicted a longitudinal first fold line 22 which separates two sections 24, 26 which are symmetric with respect to one another.

Figure 1B:
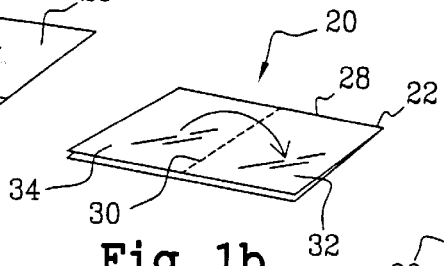

FIG. 1*b* depicts the supple sheet 20 folded in two, the longitudinal fold line 22 of which forms a longitudinal border 28, and on which a transverse fold line 30 has been depicted, this delimiting two panels 32 and 34 which are symmetric one with respect to the other.

Figure 1C:
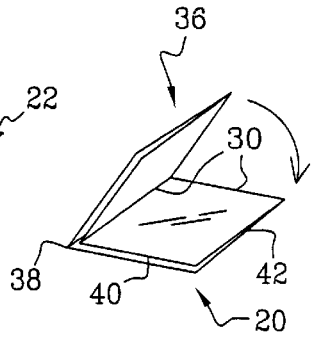

FIG. 1*c* depicts the supple sheet 20 on the point of being folded into four equal parts and which will be denoted in the remainder of the description by the reference 36. The transverse fold line 30 forms a transverse border 38. The folded supple sheet 36 therefore has a longitudinal edge 40 and a transverse edge 42 each of which consists of the superposition of the four superposed free edges of the supple sheet 20.

According to an alternative form of folding, not depicted, the longitudinal fold line delimits two sections, the transverse dimension one of which differs from the transverse dimension of the other.

The folded supple sheet may also have two transverse fold lines so as to form a central panel and two end flaps, each of which extends either facing one and the same side of the central panel, so as to form a so-called C-fold, or each of which faces one of the sides of the central panel, so as to form a so-called Z-fold.

The remainder of the description will relate, non-limitingly, to a supple sheet 36 folded in four.

In the remainder of the description, when a stack is described, the references denoting identical parts of each sheet of the stack will be made up of three figures, the first two identifying the part of the sheet, and the third and last FIG. identifying the sheet to which this reference belongs.

Figure 2:
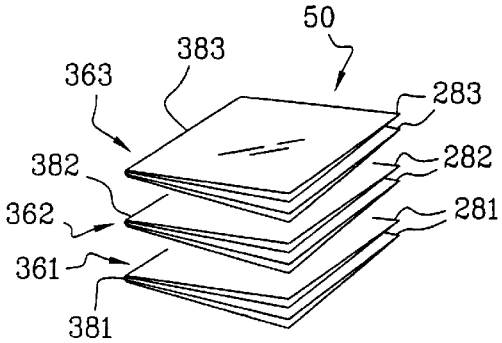
FIG. 2 is a perspective view illustrating a stack of three folded supple sheets stacked according to the state of the art.

FIG. 2 depicts the stack 50 of three folded sheets 361, 362 and 363 according to the state of the art. The longitudinal borders 281, 282 and 283 are superposed and the same is true of the transverse borders 381, 382 and 383.

Figure 3:
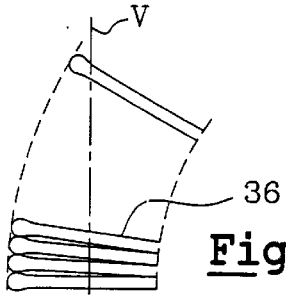
FIG. 3 is a schematic view in cross section of a stack containing a great many folded supple sheets stacked according to the state of the art.

FIG. 3 depicts a stack 50 according to the state of the art, of a great many folded sheets 36. It illustrates the imbalance of the stack 50 with respect to an axis of stacking V which here is roughly vertical. When this imbalance exceeds a limiting value, the stack 50 topples and causes the folded sheets 36 to fall off.

To avoid the stack 50 toppling, the invention proposes to balance it.

To do this, the longitudinal fold line 22 of an upper sheet of the stack must not be adjacent to the longitudinal fold line 22 of the previous lower sheet.

Figure 4:
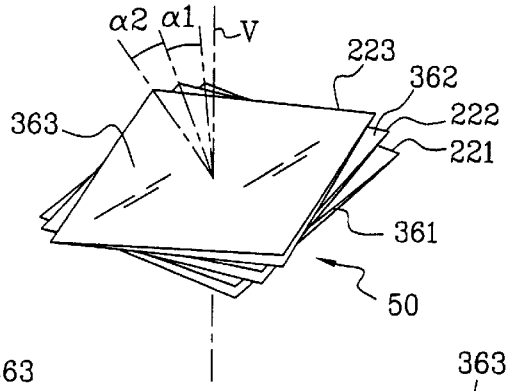
FIG. 4 is a perspective view of a first example of a stack of three folded supple sheets stacked according to the invention.

FIG. 4 depicts a first example of a stack 50 according to the invention of folded sheets 36. The longitudinal fold line 222 of the intermediate folded sheet 362 is here angularly offset by an angle $\alpha 1$ about the vertical axis V with respect to the fold line 221 of the lower folded sheet 361. Likewise, the longitudinal fold line 223 of the upper folded sheet 363 is angularly offset by an angle $\alpha 2$ about the vertical axis V with respect to the longitudinal fold line 222 of the intermediate folded sheet 362, and so on, the angles $\alpha 1$, $\alpha 2$, etc. preferably being equal.

The angular offset can vary between a few tenths of a degree of angle and 180 degrees.

The axis of such a stack 50 is roughly coincident with the vertical axis V. Thus, when the sum of the angles a is equal to 360 degrees, the stack 50 is balanced and runs no risk of toppling.

According to a second advantageous exemplary embodiment of the invention, the angle $\alpha$ of the longitudinal fold line 222 of the intermediate folded sheet 362 with respect to the fold line 221 of the lower sheet is equal to 180 degrees, which corresponds to half a turn.

Figure 5:
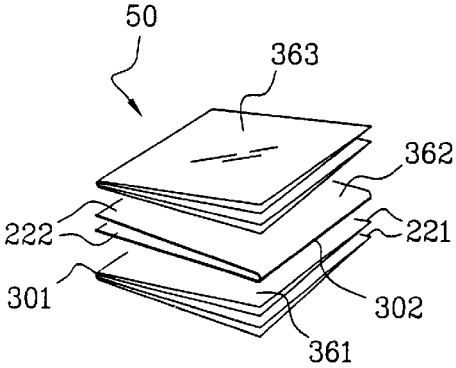
FIG. 5 is a perspective view of a second example of a stack of three folded supple sheets stacked according to the invention.

FIG. 5 depicts this second exemplary embodiment. In this case, the longitudinal fold line 222 of the intermediate sheet 362 is parallel to and transversely opposite the fold line 221 of the lower sheet 361, and the transverse fold line 302 of the intermediate sheet is parallel to and longitudinally opposite the transverse fold line 301 of the lower sheet 361. The stack 50 is balanced.

This second exemplary embodiment makes it possible to minimize the transverse bulk of the stack 50. Now, this bulk roughly corresponds to the transverse dimension of the folded sheets 36 whereas, in practically all other instances, the transverse bulk roughly corresponds to a disc whose diameter corresponds to the diagonal of the folded sheets 36.

According to a third exemplary embodiment, the successive folded sheets 36 can be intertwined.

Figure 6:
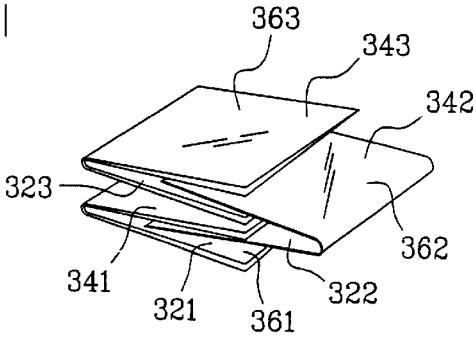
FIG. 6 is a perspective view of a third example of a stack of three folded supple sheets intertwined according to a preferred embodiment of the invention.

According to FIG. 6, the lower 361 and upper 363 folded sheets are intertwined with the intermediate folded sheet 362. The upper panel 341 of the lower sheet 361 and the lower panel 323 of the upper sheet 363 are placed between the lower 322 and upper 342 panels of the intermediate folded sheet 362.

Intertwining the folded sheets 36 makes it possible, particularly when the stack 50 is placed in a dispenser, for the lower panel 323 of the upper sheet 363 to carry (by virtue of the friction forces) the upper panel 342 of the intermediate folded sheet 362 out of the opening that allows the folded sheets 36 to be grasped.

Figure 7:
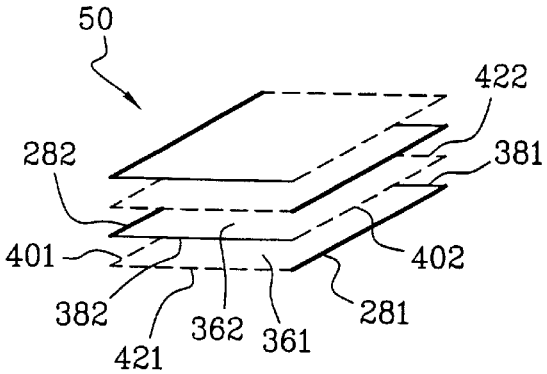
FIG. 7 is a schematic perspective view of a stack of supple sheets similar to the one depicted in FIG. 5.
Figure 11:
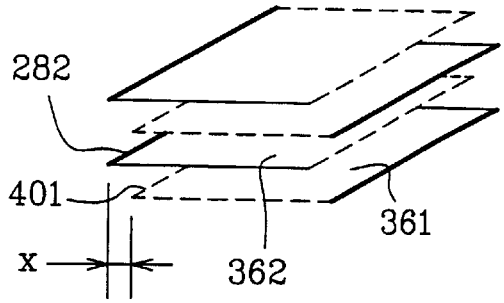
FIG. 11 is a schematic view similar to the view of FIG. 7, in which the upper sheets are longitudinally offset with respect to the adjacent lower sheet.
Figure 12:
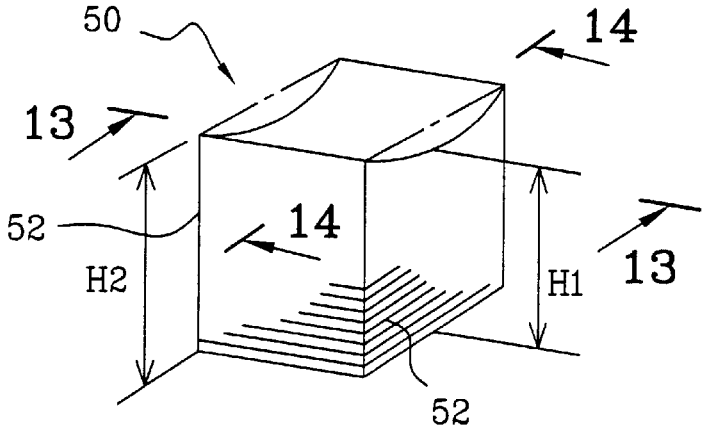
FIG. 12 is a schematic perspective view similar to the view of FIG. 8, in which the upper sheets are longitudinally offset with respect to the adjacent lower sheet.
Figure 13:
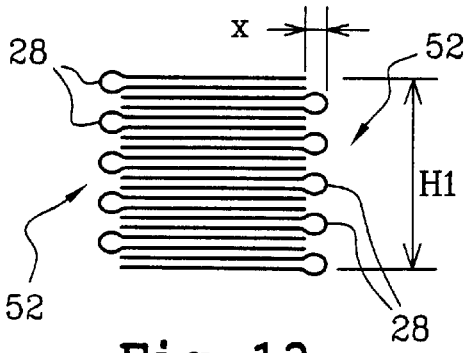
FIG. 13 is a view in cross section of the stack on a vertical plane passing through 13—13 of FIG. 12.
Figure 14:
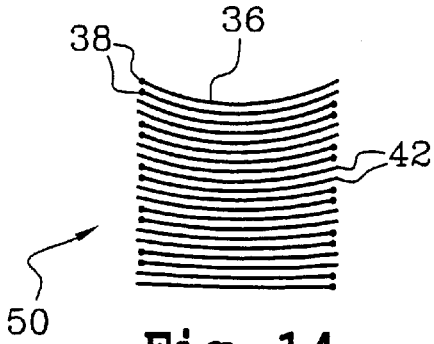
FIG. 14 is a view in longitudinal section of the stack on a vertical plane passing through 14—14 of FIG. 12.

To allow a better understanding of FIGS. 7, 11 and 15, the longitudinal borders 28 are depicted in bold line, the transverse borders 38 are depicted in fine line and the longitudinal 40 and transverse 42 borders are depicted in broken line.

Figure 8:
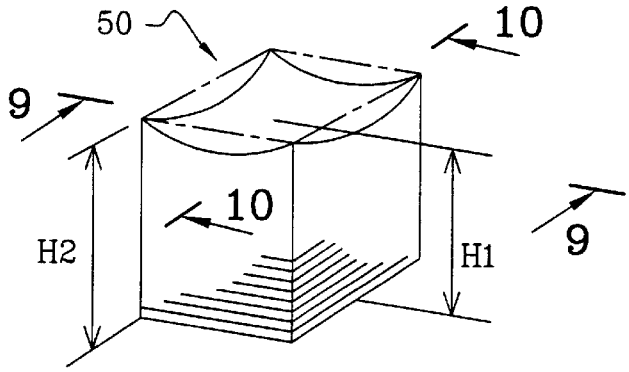
FIG. 8 is a schematic perspective view of the second example of a stack of a great many supple sheets according to the particular embodiment of the invention.

The stack 50 according to the second exemplary embodiment of the invention is depicted in FIGS. 7 to 10. FIG. 8 illustrates the stack 50, particularly the uppermost folded sheet 36 located at the top of the stack 50. The height of the stack measured between the center of the lowermost bottom folded sheet and the center of the uppermost top folded sheet 36 corresponds to a first height HI. The height of the stack measured between a corner of the bottom folded sheet and a corner of the top folded sheet 36 corresponds to a second height H2 which is greater than the first height H1.

The curved shape of the top folded sheet 36 is due to the superpositions of the longitudinal edges 28 and borders 40 and of the transverse edges 38 and borders 42 respectively, which are thicker than a simple superposition of the four thicknesses of the sections 24, 26 and panels 32, 34 of the supple sheet 20.

This curved shape does not, however, allow the vertical bulk of the stack 50 to be minimized.

Figure 9A:
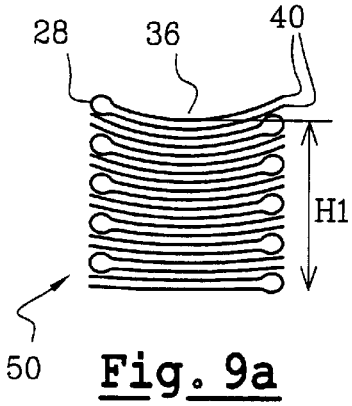
FIG. 9*a* is a is a view in cross section of the stack on a vertical plane passing through 9—9 of FIG. 8.
Figure 9B:
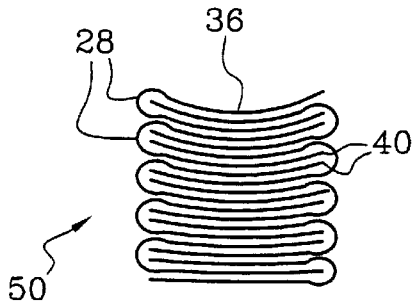
FIG. 9*b* view similar to the one depicted in FIG. 9*a*, of the third example of the stack of folded and intertwined supple sheets.
Figure 10:
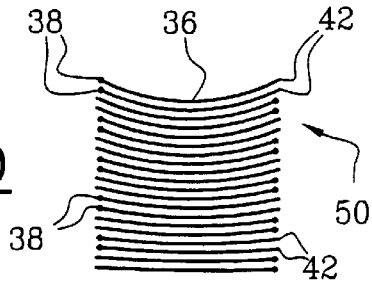
FIG. 10 is a view in longitudinal section of the stack on a vertical plane passing through 10—10 of FIG. 8.

FIG. 9*b* depicts, in cross section, the third exemplary embodiment of the stack 50. The folded sheets 36 are intertwined.

The invention also proposes, according to FIGS. 11 to 14, for the longitudinal border 282 of the intermediate sheet 362 to be transversely offset by a distance "x" of the order of a few millimeters towards the outside of the stack with respect to the longitudinal edge 401 of the lower sheet 361, and so on.

For a stack 50 containing "n" folded supple sheets 36, the longitudinal lateral sides 52 consist of the superposition of n/2 longitudinal borders 28. Thus, each longitudinal border 28 may extend vertically in a zone whose height is here equal to twice the thickness of a folded sheet 36, namely eight times the thickness of the supple sheet 20. In general, the height of these zones exceeds the thickness of the longitudinal borders 28. The folded supple sheets 36 therefore, in cross section depicted in FIG. 13, have a horizontal cross section.

Similarly, according to FIG. 15, the invention proposes, in addition to transversely offsetting the folded sheets 36, for the transverse border 382 of the intermediate sheet 362 to be offset longitudinally by a distance "y" of the order of a few millimeters towards the outside of the stack with respect to the transverse edge 421 of the lower sheet 361, and so on.

Thus, the transverse borders 38 do not cause any excess thickness. The top folded sheet 36 of the stack 50 is therefore flat according to FIGS. 16 to 18. The height HI of the stack 50 thus produced is therefore minimal.

In order to produce a stack 50 of folded supple sheets 36 according to the invention, a method is proposed for stacking the sheets 20 of supple and absorbent material, which method is of the type comprising several successive steps.

A first step consists in folding two separate supple webs, which may consist of several thicknesses of supple material, in the longitudinal direction about a longitudinal fold line 22 so as to produce two sections 24 and 26 which may advantageously be symmetric with respect to one another, particularly in the case of square or rectangular table napkins.

The direction in which the sections 24 and 26 are folded with respect to the longitudinal fold line 22 may be the same for each of the two webs of material. In this case, the method according to the invention comprises a step which consists in turning one of the two webs over longitudinally so that the longitudinal borders of each of the two webs are located on the opposite side with respect to the web to which it belongs.

The direction of folding of the sections 24 and 26 with respect to the fold line 22 of the method according to the invention may also be opposite directions for each of the two webs of material. Thus, the longitudinal borders of each of the two webs are located on the opposite side with respect to the web to which it belongs.

The second step allows transverse cuts to be made at regular intervals so as to produce sheets 20 folded along the fold line 22.

The third step consists in folding the folded sheet 20 about the transverse fold line 30 so as to produce the folded supple sheets 36.

The fourth and last step is to stack and intertwine the folded supple sheets 36.

This method makes it possible to obtain a stack 50 of folded supple sheets 36 which is balanced.

In a variant, two successive supple sheets 36 may be longitudinally and/or transversely offset with respect to each other so as to reduce the height of the stack 50.

Figure 19:
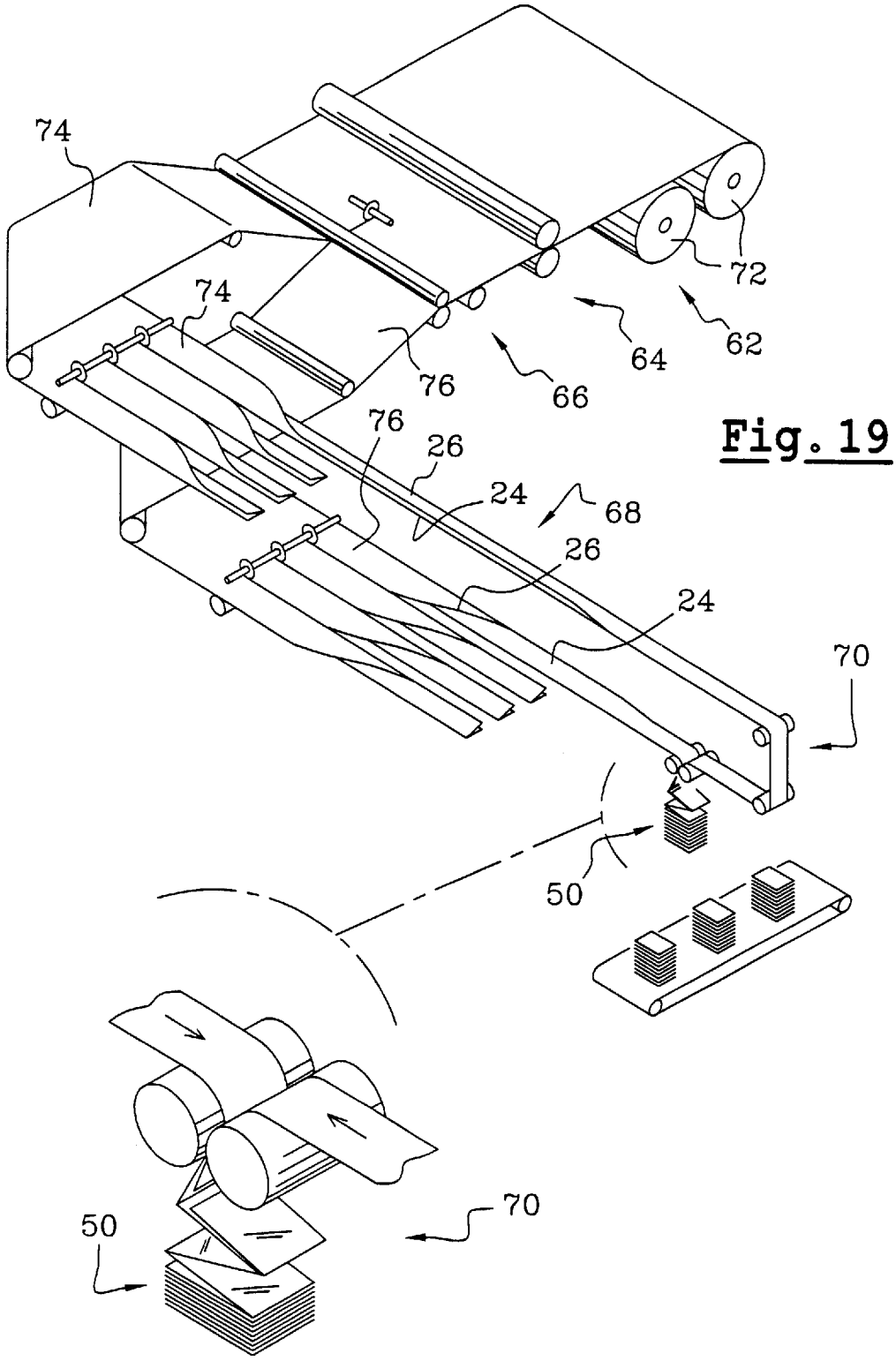
FIG. 19 is a schematic view of one example of an installation for manufacturing stacks of folded and intertwined sheets according to the invention.

FIG. 19 schematically illustrates an installation 60 for implementing the above-described method for the manufacture of stacks 50 of folded and intertwined sheets 36.

According to the exemplary embodiment depicted, the installation 60 is made up mainly of two paying-out devices 62, of a goffering unit 64, of a longitudinal cutting unit 66, of a longitudinal folding unit 68 and of a unit 70 concerned with transverse cutting, transverse folding and stacking with intertwining. This exemplary embodiment is non-limiting.

Each paying-out device 62 comprises a reel 72 of supple material, such as cellulose wadding. The web of supple material from each reel 72 is paid out and passed through the goffering unit 64 which combines the two webs in such a way as to produce a single web which, in this instance, consists of two thicknesses. The goffering unit 64 is made up of two cylinders. The goffering unit 64 may also comprise a bonding device which makes it possible to improve the association of the two thicknesses of supple material.

The single web is then cut longitudinally to produce a top web 74 and a bottom web 76.

The installation 60 may produce several stacks 50 simultaneously because in fact the top 74 and bottom 76 webs are cut longitudinally for a second time so as to produce webs the width of which corresponds to the transverse dimension of the supple sheet 20.

In what follows, only the operations performed on a top web 74 and a bottom web 76 will be described.

The longitudinal folding unit 68 of the installation 60 then folds the top 74 and the bottom 76 webs about the fold line 22 using a known method. The fold lines 22 thus delimit two sections 24 and 26 on each of the top 74 and bottom 76 webs.

According to the invention, the folding of the top web 74 consists in turning the section 26 down on to the section 24 and the folding of the bottom web 76 consists in turning the section 24 down on to the section 26. Thus, the longitudinal fold line 22 of the top web 74 is roughly opposed, with respect to the bottom web 76, to the longitudinal fold line 22 of the bottom web 76.

The two longitudinally folded webs, top 74 and bottom 76, are then fed into the unit 70 of known type described in detail in European patent application EP-A-0.286.538.

The unit 70 cuts the top 74 and bottom 76 webs transversely to produce longitudinally folded sheets 20 and then folds the sheets 20 transversely into sheets 36 and stacks them.

The unit 70 also allows the folded sheets 36 to be intertwined.

What is claimed is:

1. A stack (50) of supple and absorbent sheets (20), each of which comprises a longitudinal fold line (22) forming a longitudinal border (28) and at least one transverse fold line (30) perpendicular to the longitudinal fold line (22) and which are all folded identically, in which the longitudinal (22) and transverse (30) fold lines of an upper folded sheet (36) in the stack are not adjacent to the respective longitudinal (22) and transverse (30) fold lines of the subjacent folded sheet (36), and in which the longitudinal fold line (22) of an upper folded sheet (36) is parallel to and transversely opposite the longitudinal fold line (22) of the subjacent folded sheet (36) and the transverse fold line (30) of the upper folded sheet (36) is parallel to and longitudinally opposite the transverse fold line (30) of the subjacent folded sheet (36), wherein the longitudinal fold line (22) of the upper folded sheet (36) is transversely offset toward the outside of the stack (50) with respect to the longitudinal edge (40) of the subjacent folded sheet (36).

2. A stack (50) according to claim 1, wherein two successive folded sheets (36) are interweaved.

3. A stack (50) according to claim 1, wherein the longitudinal fold line (22) of the upper folded sheet (36) is superposed with the longitudinal edge (40) of the subjacent folded sheet (36) which edge is the edge opposite the longitudinal fold line (22) of said subjacent sheet (36).

4. A stack (50) according to claim 1, wherein at least one of the transverse fold lines (30) forming a transverse border (38) of the upper folded sheet (36) is superposed with the transverse edge (42) of the subjacent folded sheet (36) which edge is the opposite edge of the corresponding transverse fold line (30) that forms the transverse border (38) of the subjacent folded sheet (36).

5. A stack (50) according to claim 1, wherein at least one of the transverse fold lines (30) forming a transverse border (38) of the upper folded sheet (36) is longitudinally offset toward the outside of the stack with respect to the transverse edge (42) of the subjacent folded sheet (36).

6. A stack (50) according to claim 1, wherein the longitudinal fold line (22) delimits two sections (24, 26) the transverse dimensions of which are substantially equal.

7. A stack (50) according to claim 1, wherein the longitudinal fold line (22) delimits two sections (24, 26) the transverse dimension of one of which is at most twice the transverse dimension of the other.

8. A stack (50) according to claim 1, wherein the sheets (20) are folded about two transverse fold lines (30) so as to form a central panel and two end flaps which extend facing one same side of the central panel.

9. A stack (50) according to claim 1, wherein the sheets (20) are folded about two transverse fold lines (30) so as to form a central panel and two end flaps, each of which extends facing one of the sides of the central panel.

10. A stack (50) according to claim 1, wherein each sheet (20) is folded into four superposed layers about a longitudinal fold line (22) and about a perpendicular transverse fold line (30) so as to form a stack of square folded sheets (36).

11. A stack (50) according to claim 1, wherein each folded sheet (36) of the stack (50) consists of at least one ply of supple and absorbent material.

* * * * *